United States Patent [19]

de Bruyne

[11] 3,955,802

[45] May 11, 1976

[54] ORBITAL OSCILLATING STIRRER

[76] Inventor: Norman Adrian de Bruyne, 3700 Brunswick Pike, Princeton, N.J. 08540

[22] Filed: Mar. 24, 1975

[21] Appl. No.: 561,346

[52] U.S. Cl. ..... 259/117; 259/116

[51] Int. Cl.[2] ..... B01F 11/00

[58] Field of Search ..... 259/116, 117, DIG. 42, 259/DIG. 43, 99, 100, 101, 61, 62, 63, 37, 38, 39

[56] References Cited

UNITED STATES PATENTS

| | | | |
|---|---|---|---|
| 1,393,799 | 10/1921 | Laurick | 259/37 |
| 3,468,520 | 9/1969 | Duryea et al. | 259/39 |
| 3,484,204 | 12/1969 | Caviness | 259/98 |

FOREIGN PATENTS OR APPLICATIONS

| | | | |
|---|---|---|---|
| 594,923 | 11/1947 | United Kingdom | 259/116 |

*Primary Examiner*—Stanley N. Gilreath
*Assistant Examiner*—Donald B. Massenberg
*Attorney, Agent, or Firm*—William F. Frank

[57] ABSTRACT

A stirring rod is inserted through a resilient suspension diaphragm which is sealably secured to the underside of a closure for a flask or container. An L-shaped support bracket is attached to the outer, upper surface of the closure. The upstanding leg of the bracket carries an expansible pressurizable chamber which is connected, on its outerside, to a supply of single phase ACA and, on its innerside, to the upper portion of the stirring rod extending above the closure by a horizontal link which, at one end, is fitted over the stirring rod and at the opposite end is secured to the expansible chamber. The horizontal leg of the bracket which is secured to the closure carries, at its extremity opposite the upstanding leg, support means, to the upper end of which is attached a camming plate. The camming plate extends toward the upper portion of the stirring rod but stops short of this portion to allow controlled lateral movement of the stirring rod toward the camming plate. The edge of the camming plate nearest the stirring rod is set at an angle with reference to the direction of the lateral movement of the link resulting from the application of the single phase ACA. As a result of this angular relationship, a component of force in a direction at a right angle to the movement of the link is introduced when the stirring rod contacts this edge. This component of force is in a horizontal plane parallel to, preferably below, the horizontal plane in which the link is moving. As a result, the stirring rod is caused to deviate from its movement in the horizontal X plane into a continued movement into the Y plane to the limit imposed by the movement of the link as its movement is continued by the positive pressure. The application of the cycle of negative pressure to the chamber causes the upper stirring rod portion to return with the link. The path thus scribed by the stirring rod has become orbital in form in liew of a simple back and forth path in the X plane. This stirring apparatus permits the flask to be placed vertically or to be inclined.

9 Claims, 4 Drawing Figures

FIG. I
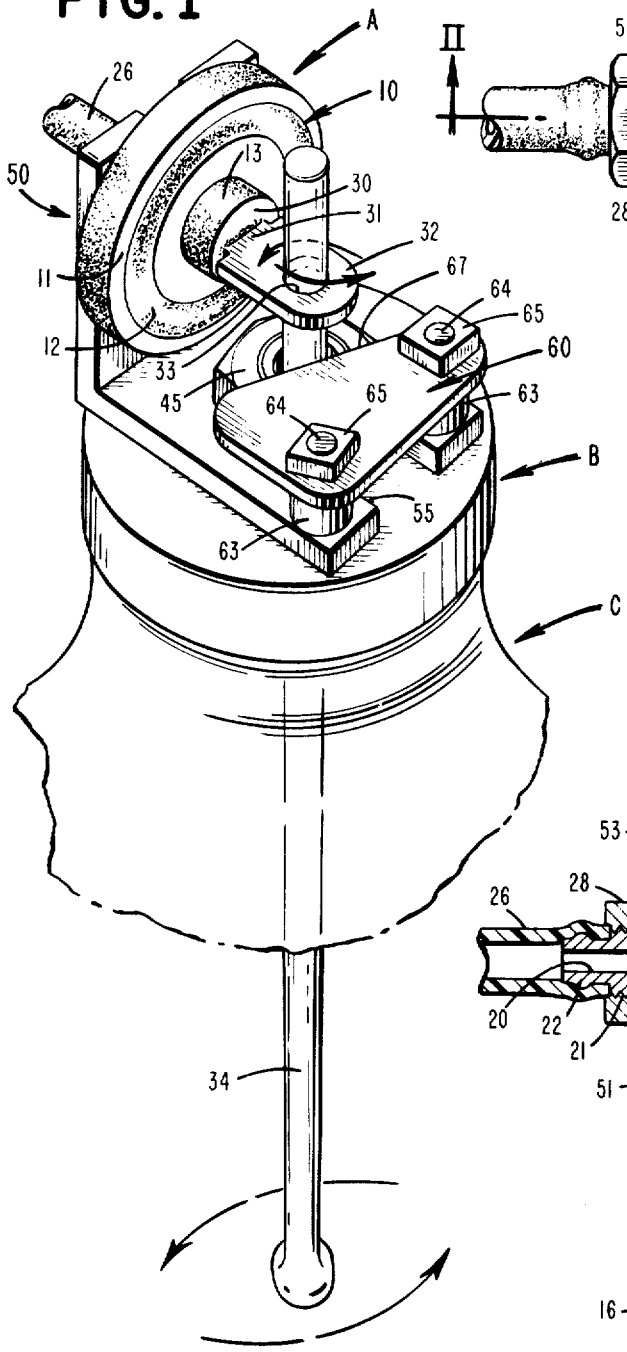
FIG. III
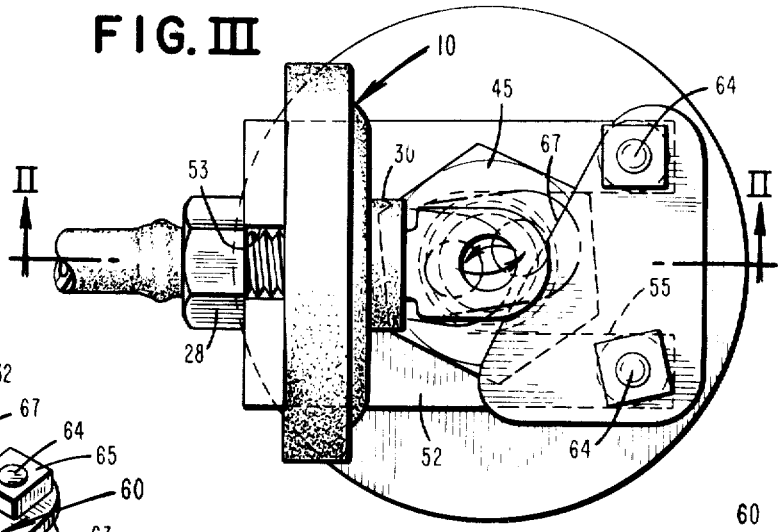
FIG. IV
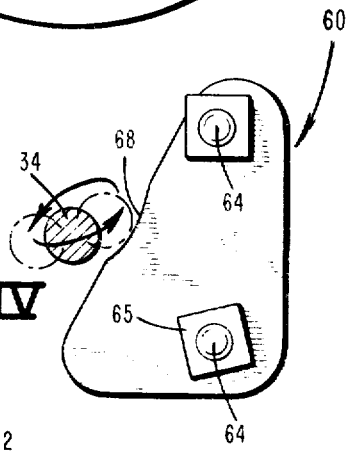
FIG. II
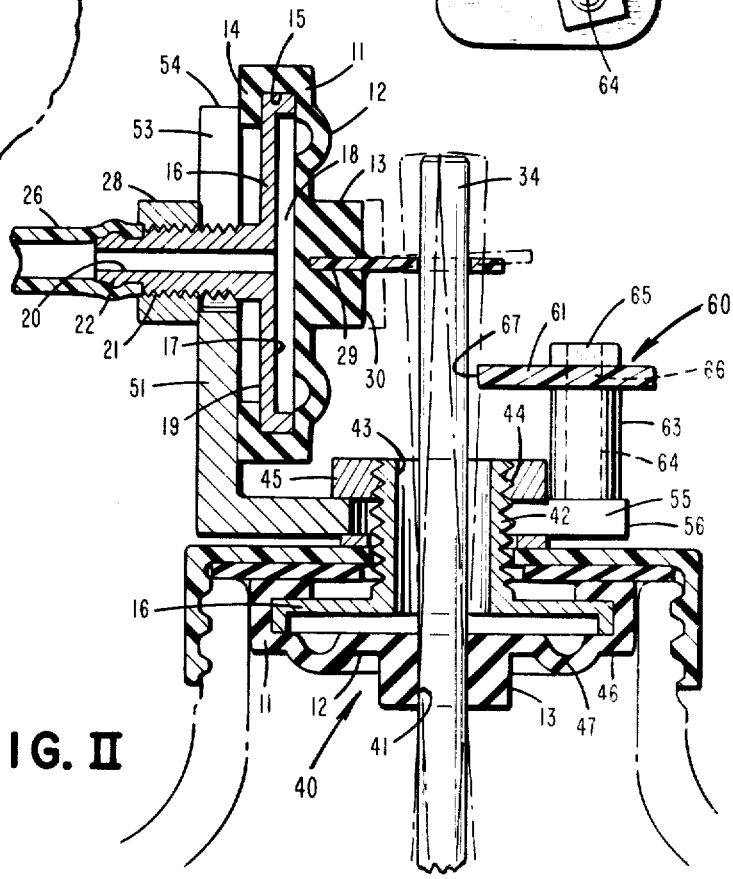

ORBITAL OSCILLATING STIRRER

FIELD OF INVENTION

This invention is in the field of stirrers used in mixing and agitating liquid compositions. More particularly, the invention lies in that area of oscillating stirrers whose movement is caused by the application of alternating current air (ACA) pressures to the stirrer assemblies.

BACKGROUND OF THE INVENTION AND PRIOR ART

In the matter of stirring liquids by apparatus in lieu of hand-stirring, the attempt has always been to obtain circulation of the liquid composition within the container. The greater degree of circulation results in improved intermingling and homogenizing of the composition or better dispersion of particles within the liquid. In many instances, heat must be applied to the container in addition to he stirring action to achieve the desired results. In other instances, such as certain laboratory work, heating must be avoided, be it from external sources or as can be developed by the very motion and operation of the stirring apparatus.

The path to be followed by the stirrer can enhance the stirring if the proper motion is imparted to the stirrer. In contrast, stirring will be ineffective if the path of the stirrer does not cause the necessary motion within the liquid composition. It is most desirable if the stirrer can impart motion to the liquid so that the liquid moves in a vertical direction and at the same time in a horizontal direction.

In attempting to achieve such motion, oscillating stirrers normally are of a type which can be referred to as "plungers," that is, the stirrer is moved up and down in a generally vertical plane. The stirrer frequently has some device attached at or near the end portion in the liquid to impart motion to the liquid.

U.S. Pat. No. 3,484,204 discloses such a stirrer driven by application of alternating positive and negative pressures to the interior of a reactor vessel containing a vertically moving rod having an enlargement on the lower end. U.S. Pat. No. 2,702,693 discloses use of a vertically moving stirrer having two pivotally mounted spring-biased arms with paddles in their end portions. Generally speaking, the motion of the liquid, when agitated by the above devices, will be in the same arcuate path in the vertical plane. In some instances the stirrer actuator will impart heat to the liquid which may be undesirable, particularly in laboratory work.

Another development to improve liquid flow was the magnetic stirrer, consisting of a bar magnet which is at the bottom of the vessel containing the liquid to be stirred and which is rotated by an external rotating magnetic field. This has become one of the preferred methods of light duty stirring. It has three disadvantages. The motor, which produces the external rotating magnetic field by rotating a permanent magnet, generates uncontrolled heat. Stirring ceases if the liquid is removed from the vicinity of the rotating magnetic field. If controlled heating is required it is necessary to use a specially designed electric hot plate or heating mantle which incorporates the motor. It is impossible to use a bunsen burner or a regulator electric hot plate. These three disadvantages are not usually serious in general laboratory practice but in the technique of spin culture of tissues and cells they cause complications and expense. Even though it is possible to insulate the passage of heat from the stirrer motor to the vessel, it is impossible to put the stirrer and vessel in a bench type incubator because the heat transferred to the air in the incubator will cause the temperature to rise above 37°C. Either one must add a refrigerator to the incubator or work in a constant temperature room. An additional complication in tissue culture stirring is that the bar magnet must be kept off the bottom of the vessel, otherwise the cells will be damaged.

To overcome the disadvantages of the electrically actuated stirrers of the prior art as exemplified in the foregoing, my co-pending U.S. patent application Ser. No. 491,832 discloses the use of low pressure alternating current air, which shall be referred to as ACA throughout the remainder of this application. The ACA is delivered through a rubber stopper for the liquid container to the underside of which stopper there is cemented a rubber diaphragm seal having a flexible horizontal surface which is spaced from the underside of the stopper. A stirrer in the form of a glass or stainless steel rod is pushed into a tabulation at the center of the underside of the horizontal surface of the diaphragm. A horizontal perforated disc is attached to the lower end of the stirrer. The vertical oscillation of the stirrer imposed by the action of ACA against the diphragm generates stirring action and imparts movement to the liquid in the form of a torus which is continuously being turned inside out. The container is kept vertical for best results.

To improve the stirring action so as to impart motion to the liquid to cause it to move in X, Y and Z planes in an orbital path as occurs more closely in manual stirring, a known device discloses the use of a container closure which has two abutments of differing lengths depending from a disc through which ACA passes to strike a diaphragm held in place on the container by its closure. The diaphragm is a horizontal stiff disc with a stirrer depending from its underside. The ACA causes flexing of the stiff disc which is given a nutating motion by repeatedly striking the abutments of differing length. This nutating motion of the disc generates an orbital type of motion of the stirrer in the X, Y and Z planes of the liquid. The stirring of the liquid is improved over that of U.S. patent application Ser. No. 491,832. However, the diaphragm wears out rapidly as a result of striking the abutments. Again, the container must be kept vertical for best results.

The oscillatory stirring apparatus in my co-pending U.S. patent application Ser. No. 458,846 is a marked improvement over the known apparatus in that a pair of novel abutment plates are secured to the inner surface of the diaphragm supporting the stirring rod and strike a metal disc inserted into the diaphragm. The abutment plates are of unequal length and height in accordance with the principles of their design as disclosed in this application. Use is made of single phase ACA to impart motion to the diaphragm and the result is that the stirring motion is in an inclined elliptical path lying in the X, Y and Z planes. The stirring apparatus in this application can be secured to the various types of closures for flasks or other containers, but the flasks should be kept vertical.

My co-pending U.S. patent application Ser. No. 545,140 discloses oscillatory stirring apparatus in which either 2-phase ACA or 3-phase ACA is applied to a stirring assembly to achieve an orbital stirring path in the horizontal X and Y planes. In this application the stirring rod extends above and below a suspension diaphragm which provides a seal for the stirring rod within the flask and which is sealably secured to one of the various types of closures for flasks or containers. The portion of the stirring extending above the diaphragm and outside the flask is caused to move in an orbital path by the action of 2 or 3 expansible chambers which are cyclically, in an alternating pattern, supplied with positive and negative low pressures of ACA. The orbital path of this upper portion of the stirring rod is in the horizontal X and Y planes and normally has a small lateral displacement in each of these planes. The resultant movement of the end of the stirring rod within the flask is a similar orbital path as the upper porion outside the flask but with a lateral displacement in the horizontal and Y planes greaer than that of the upper portion in accordance with the distance of the lower end of the stirring rod from its pivotal base in the diaphragm. This 2 and 3-phase ACA system is very effective in the stirring of liquids, particularly the more viscous liquids. The stirring assembly of this application will allow the flask to be placed at an angle to the vertical and yet achieve excellent agitation.

SUMMARY OF THE PRESENT INVENTION

The present invention employs a single phase ACA to impart orbital motion in horizontal X and Y planes to a stirring rod sealably enclosed within a flask.

The stirring rod is inserted through a resilient suspension diaphragm which is sealably secured to the underside of a closure for a flask or container. An L-shaped support bracket is attached to the outer, upper surface of the closure. The upstanding leg of the bracket carriers an expansible pressurizable chamber which is connected, on its outerside, to a supply of single phase ACA and, on its innerside, to the upper portion of the stirring rod extending above the closure by a horizontal link which, at one end, is fitted over the stirring rod and at the opposite end is secured to the expansible chamber. The horizontal leg of the bracket which is secured to the closure carries, at its extremity opposite the upstanding leg, support means, to the upper end of which is attached a camming plate. The camming plate extends toward the upper portion of the stirring rod but stops short of this portion to allow controlled lateral movement of the stirring rod toward the camming plate. The edge of the camming plate nearest the stirring rod is set at an angle with reference to the direction of the lateral movement of the link resulting from the application of the single phase ACA. As a result of this angular relationship, a component of force in a direction at a right angle to the movement of the link is introduced when the stirring rod contacts this edge. This component of force is in a horizontal plane parallel to, but below, the horizontal plane in which the link is moving. As a result, the stirring rod is caused to deviate from its movement in the horizontal X plane into a continued movement into the Y plane to the limit imposed by the movement of the link by the application of positive low pressure ACA to the chamber. The application of the cycle of negative low pressure ACA to the chamber retracts the link from its extended position and the upper stirring rod portion returns with the link. The path thus scribed by the stirring rod has become orbital in form in lieu of a simple back and forth path in the X plane. This stirring apparatus permits the flask to be placed vertically or to be inclined.

DESCRIPTION OF THE DRAWINGS

The present invention in its above broad aspects is depicted in the following listing of drawing figures in which varying scales have been utilized to more clearly present the invention. The configurations shown, and subsequently to be described, are by way of illustration only and are not limiting as to size and to the full range of application of the invention.

FIG. I is a perspective view of the present invention as seen from about 45 degrees above the horizontal.

FIG. II is a cross-section of the present invention along the plane II—II in FIG. III showing the application to a flask.

FIG. III is a plan view of the present invention without the stirring rod.

FIG. IV is a plan view of the camming plate depicting an arcuate camming surface.

In the drawings, A designates generally the stirring assembly of this invention; B designates a closure for a flask or container A.

The stirring assembly A is composed of a pressure-responsive working diaphragm assembly 10, a support bracket 50 for the working diaphragm assembly 10 and a camming plate 60 to be attached to the closure B and a suspension diaphragm 40 which not only carries a stirring rod in a sealed relationship but also provides the linkage which holds the suspension diaphragm, closure and bracket together in their cooperative working relationships with each other.

The bracket 50 is L-shaped, having an upright leg 51 and a horizontal leg 52. The upright leg 51 has a slot 53 extending downwardly from the upper end 54 of the leg 51. In a like manner, horizontal leg 52 has a slot 55 extending toward the upright leg 51 from the edge 56 of leg 52. Slot 55 extends beyond the midpoint of leg 52 for reasons to be explained further on in this disclosure.

The pressure-responsive working diaphragm assembly 10 is comprised of a diaphragm 11 of resilient material having a solid, flexible wall 12 from which extends a centrally positioned boss 13 of the same material; a flat, annular ring 14 parallel to and spaced from the flexible wall 12 but connected thereto around the outer peripheries of each to form a circular recess 15 therebetween. Into recess 15 there is frictionally and sealably fitted a disc 16 which carries a recess 17 on its inner side; i.e., facing the flexible wall 12 but spaced therefrom to form a pressurizable chamber 18 between them. Extending outwardly from the center of the outer side 19 of disc 16 is a conduit 20 for ACA supply through the disc to chamber 18. The conduit 20 has a portion 21 extending from the disc along the conduit which has screw threads and a portion 22 which carries projecting means to frictionally grip and hold an ACA supply tube 26 from an ACA source. A nut 28 threaded to fit portion 21 of conduit 20 is provided for assemblying the diaphragm assembly 10 to the upright leg. A washer (not shown) such as a spacer or a lock washer may be used with the nut 28. Boss 13 has an opening 29 formed in the exposed boss face 30 into which is inserted and secured one end portion 31 of a link 32 which has an opening 33 in its free end portion to frictionlessly receive a stirring rod 34.

The diaphragm assembly 10 is mounted on bracket 50 by inserting the threaded portion 21 of conduit 20 into slot 53 on bracket leg 51 and moving the assembly along the slot until the link 32 is correctly positioned above leg 52 and nut 28 is then screwed down against the outer surface of leg 51 to secure the assembly 10 in its designated position. The use of slot 53 in lieu of a hole not only facilitates mounting of diphragm assembly 10 but provides means for adjusting the size of the orbit scribed by the stirring rod when in motion.

The suspension diaphragm assembly 40 has a diaphragm of resilient material substantially identical to that just described above in connection with the working diaphragm assembly 10 and thus the same reference numerals are used in describing both with the exception of the opening in the boss 13. The boss 13 of assembly 40 has a passageway 41 formed therein to communicate with the recess 15 in the diaphragm 11. The diameter of the passageway 41 is slightly less than the diameter of the stirring rod 34 which is inserted therethrough and pushed on until the upper portion of the stirring rod has passed through opening 33 in link 32. With the relative diameter relationships just described, the stirring rod is not only sealingly held in the diaphragm 11, but the gripping action of the boss 13 results in the boss being the pivotal zone for the stirring rod portion below the boss in the liquid. The lateral distance the lower end of the stirring rod moves from the vertical — in a state of rest — is directly proportional to the ratio of the length of the stirring rod below boss 13 to the length above the boss. This ratio can be varied in two ways; firstly by changing the position of the working diaphragm assembly 10 along the slot 53 in leg 51, and secondly, with the working diaphragm assembly in a set position, moving the stirring rod up and down through the boss 13.

Disc 16 in suspension diaphragm assembly 40 is substantially identical to disc 16 in assembly 10. Conduit 42 on disc 16 of assembly 40 differs from conduit 20 on disc 16 of assembly 10 in that the inner bore 43 is larger than the inner bore of conduit 20. This is necessary because of the amplitude of oscillation of the position of the stirring rod 34 above the boss 13 as the rod is moved by the working assembly 10. Conduit 40 has only the threaded portion 44 which serves the same purpose as threaded portion 21 on conduit 20 of assembly 10. A nut 45 is provided for threaded portion 44.

Camming plate 60 is supported above leg 52 of bracket 50 by a pair of vertical members. As shown illustratively in the drawings the members comprise a pair of vertical posts 64, one on each side of slot 55, each of which is encased by a sleeve 63 upon the upper surface of which the underside of a camming plate 61 rests. The upper end of post 64 is threaded and a nut 65 is provided to secure camming plate 61 to the sleeve 63. The posts 64 may take several forms such as a rod threaded at both ends, one end to be screwed into a tapped recess in leg 52, the other end to receive nut 65. One alternative would be a machine screw inserted through an opening (not shown) on the underside of leg 52. Other post support means will readily come to mind to those of ordinary skill in the art and are encompassed by the scope of the present invention.

The camming plate 61 has at least a thickness sufficient to provide a rigid edge 67 against which the stirring rod 34 can strike. In its simplest form, the rigid edge 67 which forms a caming surface is a straight edge which forms an acute angle with the axis of the link 32 as it extends outwardly from the boss 13. The camming edge 67 may have an arcuate form 68 in that portion which is struck by the stirring rod. The camming plate 61 is also provided with openings 66 which fit over the upper ends of posts 64.

The closure B as illustratively shown in the drawings is a conventional phenolic resin cap having interior threads which match the threads on the flask in accordance with the standards of the Glass Containers Manufacturers Institute. Another type of cap is made of polycarbonate material with tapered tabulation to fit standard ground glass joint-type flasks. These and similar rigid caps are readily adaptable for use with the present invention. The only requirement is that a hole be bored in the upper surface of each cap for the insertion of conduit 42.

For Kontes-type flasks or those having a similar type principal opening, the flexible wall 12 of the diaphragm provides a sealing surface in that a circular surface 46 on the outer periphery of the wall 12 is fitted to the top surface of the opening of the flask and a circular ring portion 47 adjoining the inner edge of surface 46 extends into the opening of the flask. A metal disc such as shown in co-pending U.S. patent application Ser. No. 458,846 receives the diaphragm assembly 40 as a substitute for the closure B in the present disclosure. The disc may be secured to the flask in the manner disclosed in co-pending U.S. patent application Ser. No. 458,846. The novel assembly may also be secured to a Kontes bottle as disclosed in a co-pending U.S. patent application Ser. No. 545,140.

The presently disclosed stirring assembly may be readily secured to the closure of the "FLEAKER" (TM) Flask manufactured by Corning Glass Co. The vertical depth of the "FLEAKER" closure will normally require that conduit 42 have a greater diameter and length than suggested by the present disclosure with reference to use with plastic closures having a comparatively minimal vertical depth. This increased diameter is necessary if the stirring rod is to achieve appropriate lateral movement. Alternatively, the present stirring assembly may be secured to a "FLEAKER" closure as disclosed in co-pending U.S. patent application Ser. No. 545,140.

Should subsequently disclosed flasks differing from those currently known in the art be developed, those of skill in the art will be able to readily adapt the present invention relating to stirring apparatus and its adaptation to known closures for current flasks without departing from the scope of the present invention as disclosed and claimed herein.

The novel stirring assembly may also be secured to tapered silicone rubber stoppers well known in cell culture art. In this type of closure, the suspension diaphragm is replaced by the stopper to which has been added a small flexible wall with depending boss as disclosed in co-pending U.S. patent application Ser. No. 545,140.

Discs 20 and 40 may be made by machining a suitable metal or plastic material having physical properties substantially equivalent to metal for the purposes disclosed herein. Alternatively, the discs can be cast or molded from appropriate materials.

In operation, a low pressure flow of ACA of positive and negative pressures flows from a source such as one of the ACA pumps disclosed in co-pending U.S. patent application Ser. No. 545,140 through tubing 26 into conduit 20 and into chamber 18. The positive pressure in the chamber causes flexible wall 12 to move away from the disc 16 thereby moving link 32 in a substantially horizontal plane along a straight path. The movement of link 32 subsequently moves the upper portion of stirring rod 34 in the same path and direction as the line while the lower portion of the stirring rod 34 in the liquid is moved in the opposite direction by reason of the pivotal function performed by boss 13 of the working diaphragm assembly 40 as it flexes the flexible wall 12 of assembly 40. The straight movement of link 32 and the upper portion of the stirring rod continues until the rod strikes camming surface 67. This contact is made before the link completes its outward movement. It is appropriate to point out that the timing of this contact can be varied by adjusting the position of the support bracket 50 on the closure B through the slot 55 and nut 45 so that the camming edge 67 is moved toward or away from the position of the stirring rod at-rest. If the camming edge is moved toward the rod, the movement of the rod in an angular path after contact is made with the camming surface will be greater than when the camming surface 67 is moved away from the stirring rod.

When the rod strikes the camming surface, the continuing positive pressure causes the upper portion of the rod to follow the contour of the surface until the positive pressure flow ceases. The negative pressure then withdraws the link toward the diaphragm 11 in a more or less direct path, so that the upper portion of the rod passes through the vertical at-rest position of the rod. As the rod follows the camming surface under positive pressure, that portion of the flexible wall 12 on the side of the diaphragm lying in the direction of the movement may be slightly depressed by the boss 13 while the portion of the flexible wall lying on the other side of the boss may be distended slightly by the distortion caused by the movement of the boss 13 and supplemented by the positive pressure. The application of the negative pressure under such conditions will cause the slightly depressed portion to depress further and earlier than the distended portion. This, in turn, will bring the upper portion of the rod back along an arcuate path to the initial straight line path and then continue as an arcuate path until the negative pressure flow ceases. The resultant path of the upper portion of the stirring rod will thus lie in horizontal X and Y planes and may approximate a figure 8 at times. The lower portion of the stirring rod in the liquid will follow the same path but with increased amplitudes in accordance with the ratio of length of the upper portion to the lower portion as discussed above.

It should be noted that the amplitudes of the orbital path in the Y plane will be greater and less in the X plane if the camming plate 61 is positioned above the link 34 in place of below as illustrated in the drawings. A convex camming surface will also increase the amplitude in the Y plane while a concave camming surface will decrease the Y plane amplitude.

The present invention is particularly effective in stirring with slow oscillations of about 5 Hertz, more so than at about 10 Hertz. This makes is particularly suited to use with suspension cell culture. The invention has been employed to successfully stir 6 liters of liquid in a 12 liter flask.

Other modifications, adaptions and uses of the novel stirring assembly will occur to those of skill in the art and are encompassed within the scope of the claims hereto which follow.

What is claimed is:

1. An orbital oscillating stirrer for fluids comprising first support means, air pressurizable means adapted to flex outwardly and inwardly under a single phase cyclic flow of ACA pressures and positioned on a first part of said first support means, means on said pressurizable means to receive and conduct said cyclic flow of ACA pressures thereto, flexible means positioned on a second part of said support means at right angles to said pressurizable means to sealingly receive and hold a stirring rod in a suspended position with a portion of said rod extending above said flexible means, linking means secured at one end to said pressurizable means and encompassing at the opposite end the upper end of said rod to move said upper end as said pressurizable means flexes, and camming means positioned on the end of said second part of said support means in opposing relationship to said pressurizable means and extending theretowards to a position selectively spaced from said upper portion of said rod.

2. The stirrer according to claim 1 wherein said first support means comprises an L-shaped bracket, said first part of said first support means comprising an upstanding leg on which said pressurizable means is adjustably secured, and said second part of said first support means comprising a horizontal leg on which said flexible means is adjustably secured, each of said legs having a slot extending along each respective leg from their respective free end to receive said pressurizable means and said flexible means.

3. The stirrer according to claim 2 wherein said flexible air-pressurizable means comprises a circular diaphragm of resilient material having a boss centrally positioned on the outer side thereof and extending outwardly therefrom, a flat annular ring parallel to and spaced from said diaphragm but joined thereto along their respective outer peripheries by a cylindrical wall to form a recess therebetween and a disc inserted into said diaphragm recess in sealing relationship, the disc having a circular recess on its inner side when inserted into said diaphragm recess to form with the inner side of said diaphragm a chamber to receive said cyclic flow through a central orifice in said disc to cause said circular diaphragm to flex outwardly and inwardly.

4. The stirrer according to claim 3 therein means on said air-pressurizable means to receive and conduct said cyclic flow comprises a conduit extending outwardly from said disc about said orifice, the surface portion of said conduit adjacent said disc being threaded to receive locking means to secure said pressurizable means to said upstanding leg, the surface portion of said conduit adjacent its outer end having means thereon to receive and retain a flexible supply tube from an ACA source.

5. The stirrer according to claim 2 wherein said flexible means comprises a circular diaphragm of resilient material having a boss centrally positioned on the outer side thereof and extending downwardly therefrom, said boss having a central orifice to slidably receive said stirring rod in sealing relationship, a flat annular ring parallel to and spaced from said diaphragm, but joined thereto along the respective outer peripheries by a cylindrical wall to form a recess therebetween, a disc inserted into said diaphragm recess in sealing relationship, the disc having a circular recess on its inner side when inserted into said diaphragm recess to allow inward movement of said circular diaphragm as the upper end of said rod is moved by said link, said disc having a central opening of a diameter to allow unobstructed movement of said rod within said opening and a conduit extending outwardly from said disc about said opening to pass through the slot in said horizontal leg of said bracket to receive locking means to secure said flexible means to said horizontal leg.

6. The stirrer according to claim 1 wherein said linking means comprises a flat, rigid member having an opening in said opposite end to receive said upper end of said rod in friction free relationship.

7. The stirrer according to claim 1 wherein said camming means comprises a rigid member having a camming surface substantially parallel to said rod and extending beyond said rod on each side thereof in angular relationship to said rod, support means attached at the lower end thereof to said horizontal leg and having means at the upper end to receive and securely hold said rigid member in camming relationship to said rod as said rod is moved to said camming surface by said linking means.

8. The stirrer according to claim 1 further including a closure for a flask containing said liquid, said closure being sealingly fitted between said flexible means and said second part of said support means.

9. An orbital oscillating stirrer/closure assembly for a flask containing a fluid comprising first support means, air-pressurizable means adapted to flex outwardly and inwardly under a single phase cyclic flow of ACA pressures and positioned on a first part of said first support means, means on said pressurizable means to receive and conduct said cyclic flow of ACA pressures thereto, flexible means sealingly fitted to the interior of a closure for said flask, said closure having a central opening in its top, said closure and flexible means being positioned on a second part of said support means at right angles to said pressurizable means, said flexible means sealingly receiving and holding a stirring rod in a suspended position with a portion of said rod extending above said flexible means and through said opening in said closure, linking means secured at one end to said pressurizable means and encompassing at the opposite end the upper end of said rod to move said upper end as said pressurizable means flexes, and camming means positioned on the end of said second part of said support means in opposing relationship to said pressurizable means and extending theretowards to a position selectively spaced from said upper portion of said rod.

* * * * *